US008610626B2

(12) United States Patent
Chang et al.

(10) Patent No.: US 8,610,626 B2
(45) Date of Patent: Dec. 17, 2013

(54) ANTENNA WITH SLOT

(75) Inventors: Li-Chi Chang, Hsinchu (TW); Yung-Chung Chang, Tuku Township (TW); Meng-Sheng Chen, Kaohsiung (TW); Chang-Chih Liu, Xinshe Township (TW); Chang-Sheng Chen, Taipei (TW)

(73) Assignee: Industrial Technology Research Institute (TW)

( * ) Notice: Subject to any disclaimer, the term of this patent is extended or adjusted under 35 U.S.C. 154(b) by 327 days.

(21) Appl. No.: 12/963,935

(22) Filed: Dec. 9, 2010

(65) Prior Publication Data

US 2012/0146853 A1 Jun. 14, 2012

(51) Int. Cl.
*H01Q 1/38* (2006.01)

(52) U.S. Cl.
USPC ..... 343/700 MS; 343/767

(58) Field of Classification Search
USPC ..... 343/700 MS, 702, 725, 767
See application file for complete search history.

(56) References Cited

U.S. PATENT DOCUMENTS

| | | | | |
|---|---|---|---|---|
| 5,835,063 | A | 11/1998 | Brachat et al. | |
| 6,407,710 | B2 | 6/2002 | Keilen et al. | |
| 6,819,287 | B2 | 11/2004 | Sullivan et al. | |
| 6,999,037 | B2 * | 2/2006 | Apostolos | 343/767 |
| 7,248,224 | B2 * | 7/2007 | Yuanzhu | 343/700 MS |
| 7,298,343 | B2 * | 11/2007 | Forster et al. | 343/767 |
| 8,279,125 | B2 * | 10/2012 | Bellows | 343/725 |
| 2003/0122722 | A1 * | 7/2003 | Sugiyama et al. | 343/767 |

FOREIGN PATENT DOCUMENTS

| | | |
|---|---|---|
| CN | 101257139 | 9/2008 |
| TW | I329385 | 2/2009 |
| TW | I309487 | 5/2009 |

OTHER PUBLICATIONS

Office Action dated Aug. 14, 2013 from corresponding application No. 201110208959.0.

Lee, Cheng-Tse, et al., "Planar Monopole With a Coupling Feed and an Inductive Shorting Strip for LTE/GSM/UMTS Operation in the Mobile Phone", IEEE Transactions on Antennas and Propagation, vol. 58, No. 7, Jul. 2010, pp. 2479-2483.

* cited by examiner

*Primary Examiner* — Tan Ho
(74) *Attorney, Agent, or Firm* — Lowe Hauptman & Ham, LLP

(57) ABSTRACT

An antenna having a signal feeding structure, an antenna conductor coupled to the signal feeding structure and forming a slot in the antenna conductor. A closing portion capacitively closing the at least one slot at a mechanically open end of the slot.

19 Claims, 8 Drawing Sheets

ANTENNA WITH SLOT

BACKGROUND

Antennas for wireless dongles need to be light, slim, short and/or small. To allow for mass production and enable lower costs, antenna designs are moving from non-planar antennas for mobile phones, such as planer inverse F antenna (PIFA), toward planar PCB antennas, such as the monopole antenna. Further, chip antennas are commonly used in small handheld wireless devices. However, compared with some PCB antennas, the chip antenna has efficiency and area issues.

SUMMARY

One or more embodiments relate to antennas for wireless transmission and/or reception of radio signals.

An antenna comprising a signal feeding structure, an antenna conductor coupled to the signal feeding structure. The antenna conductor forming at least one slot in the antenna conductor. A corresponding portion of a ground plane capacitively closing an open end of the at least one slot.

An antenna comprising a signal feed line, an antenna conductor coupled to the signal feed line and a closing portion corresponding with the antenna conductor. The antenna conductor forming at least one slot in the antenna conductor. The closing portion capacitively closing the at least one slot at a mechanically open end.

A method of at least one of transmitting or receiving a radio signal. The method comprising feeding a first signal to an antenna conductor, the antenna conductor forming at least one slot and radiating the first signal from the antenna conductor. Alternatively, the method comprising receiving a second signal into the antenna conductor and feeding the second signal from the antenna conductor. The antenna having a spectrum comprising a first frequency response peak corresponding to a length of the antenna, and at least one second frequency response peak corresponding to the length of the at least one slot.

As will be realized, one or more embodiments are capable of other and different embodiments, and the several details are capable of modification in various obvious respects, all without departing from the described embodiments.

DESCRIPTION OF THE DRAWINGS

One or more embodiments are illustrated by way of example, and not by limitation, in the figures of the accompanying drawings, wherein elements having the same reference numeral designations represent like elements throughout and wherein.

DETAILED DESCRIPTION

In a wireless communication module, an antenna usually occupies the largest area of the passive components. Thus, the inventors have identified a need to minimize the size of the antenna and maximize the efficiency of using the limited area in a wireless device. Monopole antennas cover little area in comparison to some other antenna types and are compact when formed in a folded, spiraled or meander shape. A matching network (also referred to as a matching circuit) matches the antenna impedance with that of a driving/receiving circuit to which the antenna is connected. The matching network uses passive components on a substrate area. Further, the gain and bandwidth of the monopole antenna are fixed.

Figure 1:
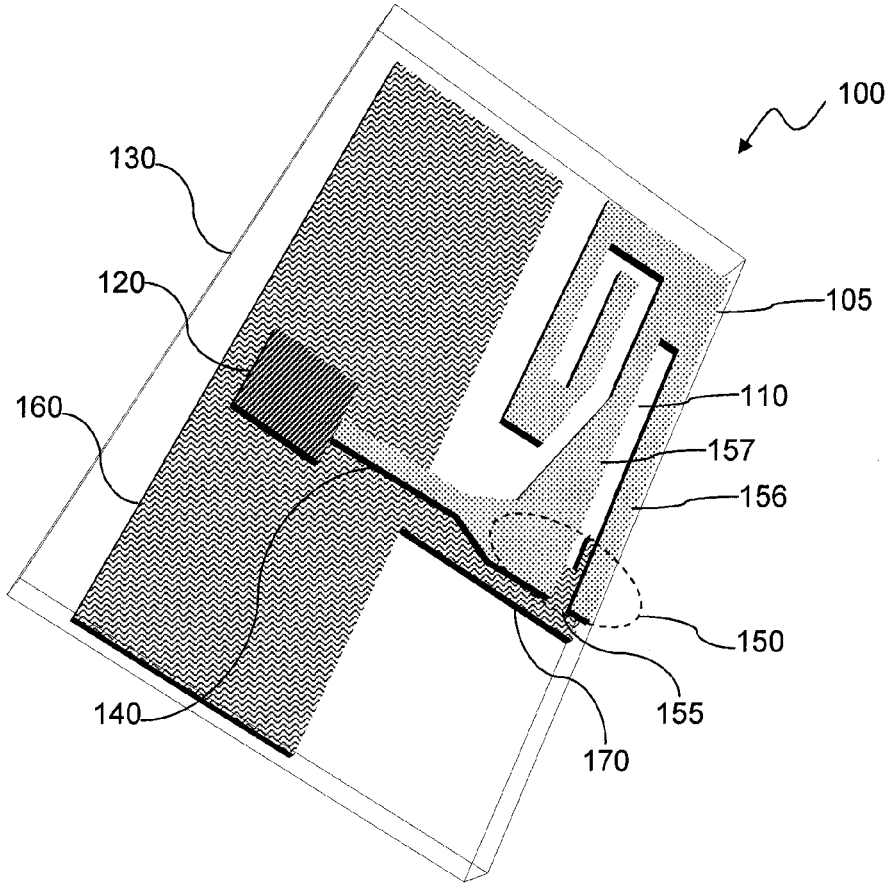
FIG. 1 is a perspective diagram of an antenna comprising a slotted antenna conductor according to an embodiment.
Figure 2:
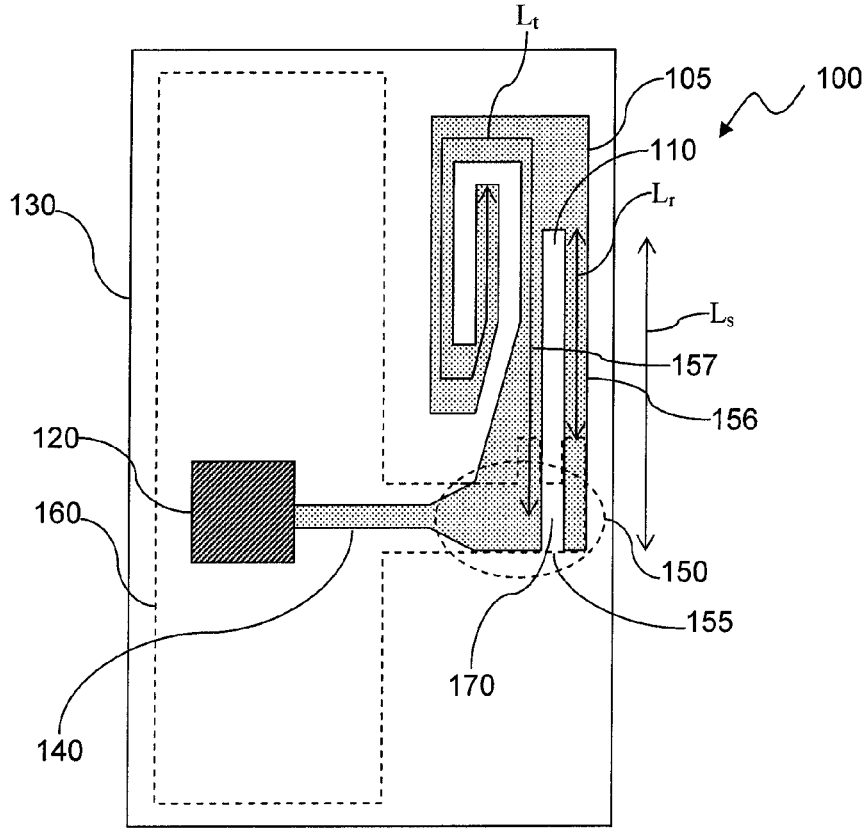
FIG. 2 is a top view of the antenna comprising a slotted antenna conductor of FIG. 1.
Figure 3:
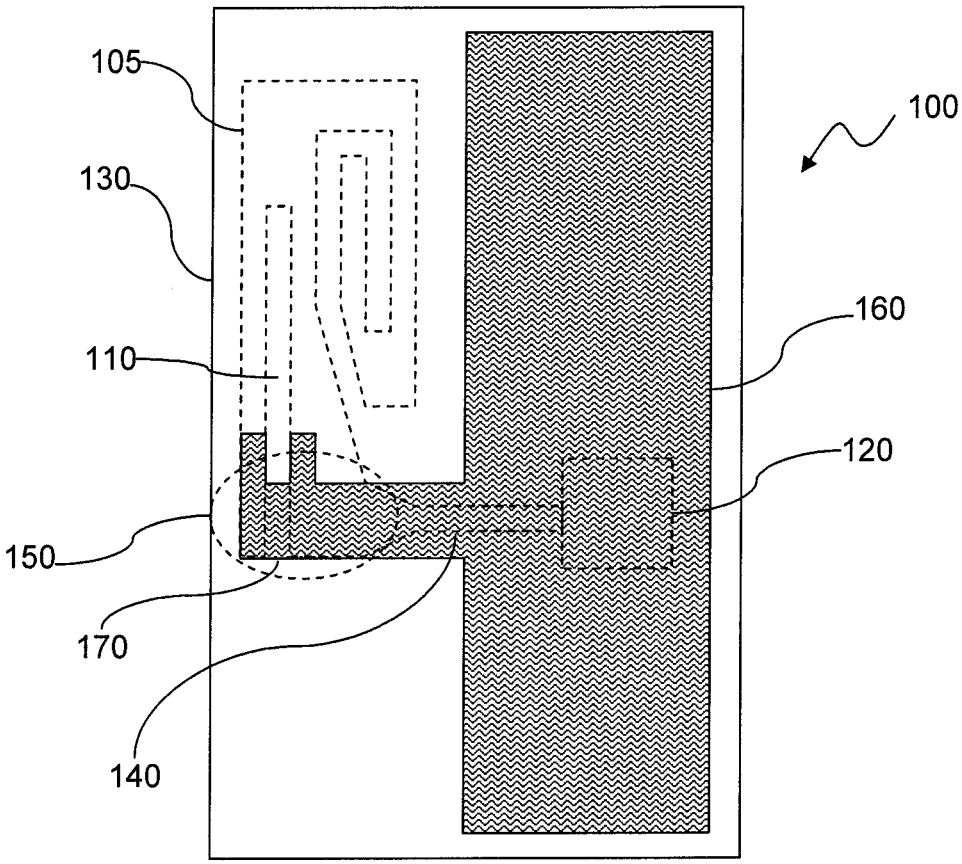
FIG. 3 is a bottom view of the antenna comprising a slotted antenna conductor of FIG. 1.

FIG. 1 is a perspective diagram of an antenna 100 comprising a slotted antenna conductor 105 having a slot 110. The antenna 100 minimizes the substrate area used by the antenna, does not incorporate matching passive components and has an adjustable gain and bandwidth. FIGS. 2 and 3 are top and bottom views, respectively, of the antenna 100.

The slotted antenna conductor 105 is a folded monopole antenna. The total effective length $L_t$ (FIG. 2) of the antenna conductor 105 is approximately ¼ the wavelength at which the antenna is designed to transmit. At a base 150 of the slotted antenna conductor 105 where the antenna conductor and the antenna feed line 140 connect, the slot 110 has a mechanically open end 155, i.e., a physical gap in the antenna conductor. The slot 110 extends from the mechanically open end 155 a distance $L_s$ (FIG. 2) along the length $L_t$ of the slotted antenna conductor 105 with a portion 156 of antenna conductor forming one side of the slot and a part of an extending tapering spiral portion 157 of antenna conductor the forming the other side of the slot. The part of the extending tapering spiral portion 157 is wide near the mechanically open end 155 and narrows farther from the open end. The remaining part of the spiral tapering portion 157 forms a decreasing flattened spiral in a direction away from the slot 110.

A ground plane 160 is formed on the opposite side of the substrate 130 away from the position of the slotted antenna conductor 105. A closing portion 170 of the ground plane 160 extends from the ground plane, and overlaps the slotted antenna conductor 105 at the base 150, electrically closing the slot 110 at the base by capacitive coupling.

The value of the capacitance formed between each side of the slot and the closing portion 170 is determined approximately by an overlap area of the slotted antenna conductor 105 at each side of the slot with the ground plane and the dielectric constant of the substrate 130. A more accurate approximation for the capacitance between each side of the slot 110 and the closing portion 170 is obtained by considering the electrical fringe fields at the edges of the slotted antenna conductor 105 and the closing portion 170. By capacitively closing the slot 110 at the base 150, the capacitively closed slot forms an LC (or resonant) circuit. By appropriately selecting the length of the slot $L_s$, the inductance of the slot is determined. By appropriately selecting the size of the closing portion 170, the thickness of the substrate 130 and the dielectric constant of the substrate, the capacitance is determined. Thus, the frequency of the LC circuit is determined based on the above-selected parameters. Selecting a value for LC corresponding to the wavelength defined by the total length $L_t$ of the slotted antenna conductor 105 increases the gain and reduces the bandwidth of the antenna. Selecting a value for LC corresponding to a wavelength shifted from the wavelength defined by the total length $L_t$ of the slotted antenna conductor 105, maintains the gain and increases the bandwidth of the antenna. Moreover, the LC circuit also enables matching of a driving/receiving circuit 120 to the slotted antenna conductor 105.

An antenna feed line 140 connects the slotted antenna conductor 105 to the driving/receiving circuit 120 on a substrate 130. The driving/receiving circuit 120 drives signals to the antenna conductor 105 or receives signals from the antenna conductor via the antenna feed line 140. The antenna feed line 140 is tapered to match the drive circuit to the antenna.

The substrate 130 is a dielectric material compatible with embodiments of the disclosure and having a dielectric constant suitable for forming the capacitors that capacitively close the slot 110 at the base 150. Suitable substrates include, for example, FR4, fiberglass printed circuit board substrates, alumina, beryllia, ceramic, glass, silicon dioxide, silicon, ferroelectric materials such as PZT, flexible substrates such as teflon, polyimide, polyetheretherketone (PEEK) or polyester. Furthermore, in some embodiments, there is no substrate and free space/nominal atmosphere separates the closing portion 170 and the slotted antenna conductor 105. If the gap that separates the closing portion 170 and the slotted antenna conductor 105 is not vacuum, examples of gases that fill the gap that separates the closing portion 170 and the slotted antenna conductor 105, include air, nitrogen and $SF_6$.

In some embodiments, the slotted antenna conductor 105 is formed on the substrate 130. The ground plane 160 and the closing portion 170 are formed over the slotted antenna conductor 105. Between the slotted antenna conductor 105 and the ground plane 160 and closing portion 170, an insulator is formed from one of the dielectric materials discussed above. In this manner, the antenna 100 is formed on one side of the substrate 130.

The slotted antenna conductor 105, the antenna feed line 140, the closing portion 170 and ground plane 160 are made from a conducting material compatible with embodiments of the disclosure. Conducting materials include metals such as aluminum, copper, gold, silver, chrome, nickel, lead, tin, alloys or multilayers of the above metals, conducting polymers, conducting pastes, low-temperature or high-temperature superconductors.

Figure 4:
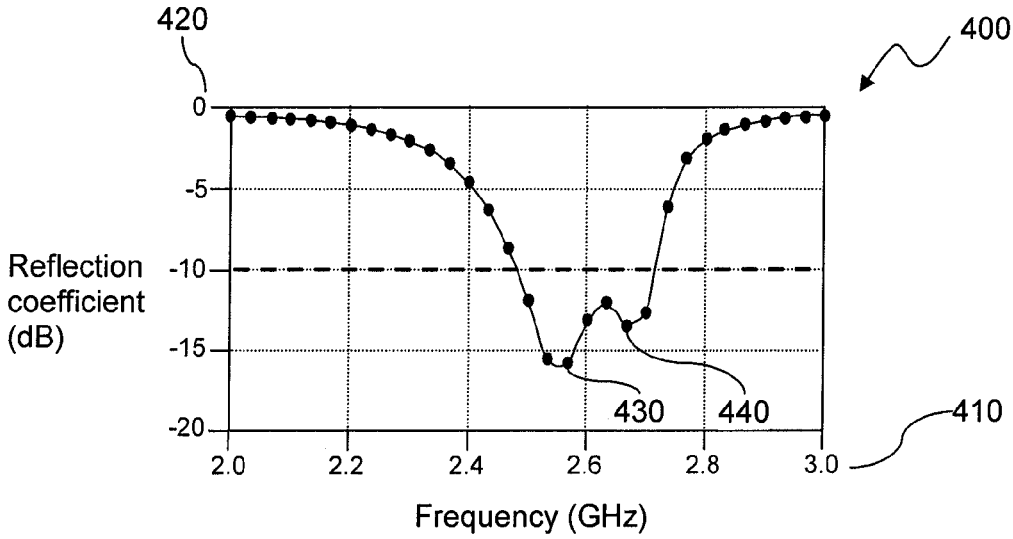
FIG. 4 is a graph of the power reflected from a driving circuit by the antenna of FIGS. 1-3 as a function of frequency.

FIG. 4 is a graph 400 of the power reflected back to the driving/receiving circuit 120 by the antenna 100 as a function of frequency. The frequency is depicted along the x-axis 410 in gigahertz and the reflected power is depicted along y-axis 420 in decibels. The antenna 100 has two reflection nulls 430 and 440 for power fed to the slotted antenna conductor 105 by the driving/receiving circuit 120. The refection nulls 430 and 440 correspond with radio frequency radiation emitted from the antenna 100. The reflection null 430 corresponds to the total length $L_t$ of the slotted antenna conductor 105. The reflection null 440 corresponds to a length $L_r$ (FIG. 2) of the slot not overlapped by the overlap portion 170 and the capacitance of the capacitively closed slot 110. Thus, the total bandwidth of the slot antenna 100 is increased compared with that of a similar antenna without a slot.

The reflection nulls 430 and 440 are caused by the antenna radiating the power provided by the driving/receiving circuit 120. Therefore, both the monopole portion of the slotted antenna conductor 105 and the portion of the slotted antenna conductor 105 with the slot radiate radio waves.

The bandwidth of the antenna 100 is approximately double when a 1/10 power point of the reflection null 430 is positioned at the same frequency as a 1/10 power point of reflection null 440. Attempting to position the reflection nulls 430 and 440 much farther apart than the point where the 1/10 power points correspond, produces an antenna with two separate transmission bands. Moreover, the matching function of the slot 110 is lost when the reflection nulls 430 and 440 are positioned too far apart.

In some embodiments, the reflection nulls 430 and 440 are positioned to coincide. If the reflection nulls 430 and 440 substantially coincide then the gain of the antenna 100 at the null is higher than that for a monopole antenna. Further, the bandwidth of such an antenna 100 is reduced compared with a non-slotted antenna conductor.

The length of the slot $L_s$ is a length compatible with embodiments of the disclosure. In some embodiments, lengths for the slot are from 1/16 to 1/8 of the wavelength that corresponds to the frequency transmitted or received by the antenna 100.

The closing portion 170 extends on the opposite side of the substrate 130 partially along the slotted antenna conductor 105 on either side of the slot 110. In other embodiments, the closing portion 170 also extends along the slot as well as on either side of the slot 110. In other embodiments, the shape of the closing portion 170 at the base 150 of the slotted antenna conductor 105 is a shape providing a suitable value for the capacitance between the base of the slotted antenna conductor and the closing portion.

The ground plane 160 is of sufficient size to allow the slotted antenna conductor 105 to radiate and receive signals. In some embodiments, the shape of the ground plane 160 and the location of the ground plane relative to the slotted antenna conductor 105, the closing portion 170 and the feed line 140 is a shape or location compatible with embodiments of the disclosure. Further in some embodiments, the ground plane 160 is formed on the same side of the substrate 130 as the slotted antenna conductor 105 or on both sides of the substrate 130.

In the embodiment of FIGS. 1-3, the slot 110 is formed with the mechanically open end at the base 150 of the slotted antenna conductor 105. In other embodiments, the mechanically open end of the slot 105 is not at the base of the antenna 105 but is placed at a distance along the antenna. A position along the antenna for the beginning and end of the slot 110 compatible with embodiments of the disclosure is within the scope of this disclosure.

Figure 5:
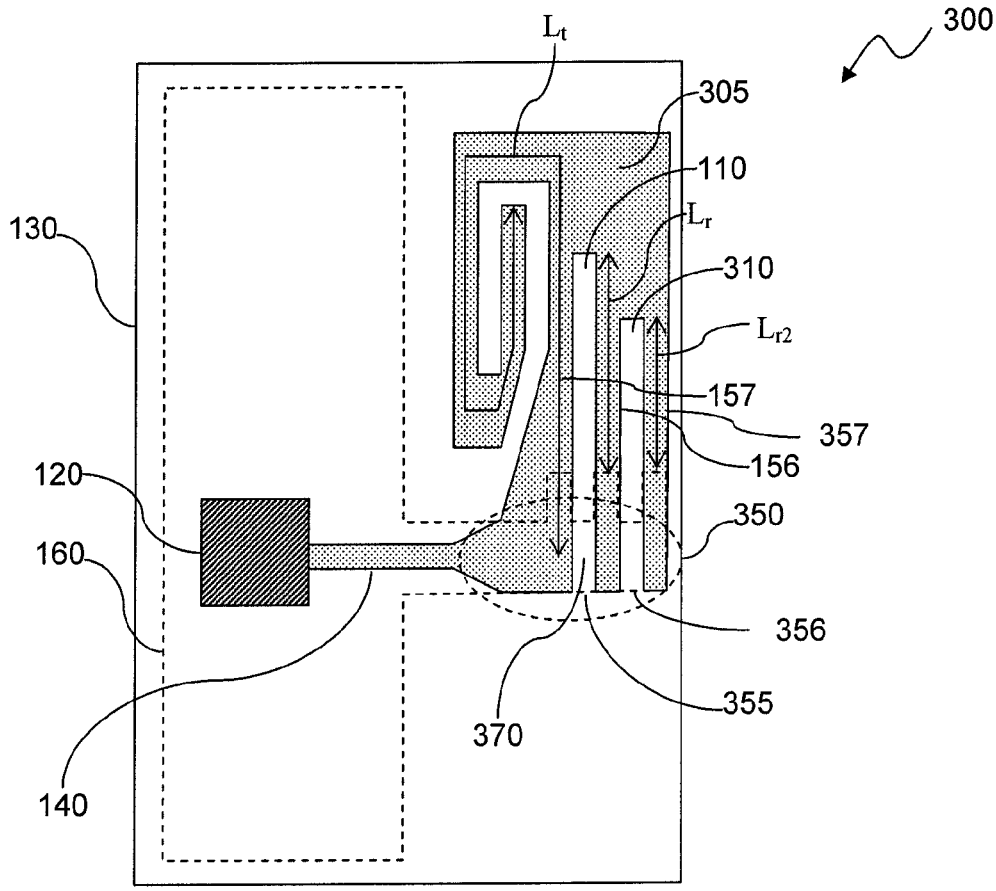
FIG. 5 is a top view of an antenna according to an embodiment.

In the embodiment of FIGS. 1-3, the antenna 100 comprises a single slot. In other embodiments, more than one slot 110 is formed by the slotted antenna conductor 105, each slot formed with a different length and capacitively closed by a corresponding closing portion 170. In some embodiments, the slots are formed adjacent to one another with a mechanically open end capacitively closed by a corresponding closing portion also adjacent and at the base 150 of the slotted antenna conductor 105. For example, FIG. 5 is a top view of an antenna 300. Antenna 300 is similar to antenna 100 but has a modified antenna conductor 305 comprising the extending tapering spiral portion 157, portion 156 and slot 110 as in FIG. 2 but antenna 300 has an additional slot 310. The slot 310 has an additional mechanically open end 357. The additional slot 310 is formed between the portion 156 of antenna conductor 305 and an additional portion 357. The length of the additional slot 310 differs from the length of the slot 110 and, therefore, produces an additional reflection null that corresponds to a length $L_{r2}$ (FIG. 5). The additional slot 310 is capacitively closed by a modified closing portion 370.

In some embodiments, the slots are formed at different positions along the slotted antenna conductor 105, with the corresponding mechanically open ends also positioned at different positions along the slotted antenna conductor 105, the slots being closed by corresponding closing portions.

In embodiments with more than one slot, the frequency of the reflection null for each slot are selected to further broaden the bandwidth of the antenna 100, to narrower bandwidth and increase the gain of the antenna or to produce a combination of broadening and gain enhancement. A combination of slot lengths and capacitor values formed by corresponding overlap portion 170 compatible with embodiments of the disclosure is within the scope of this disclosure.

In some embodiments, the slotted antenna conductor 105 is a shape other than a folded monopole. In some embodiments, the slotted antenna conductor is a spiral shape, a meander shape, straight shape, meandering shape or another shape compatible with embodiments of the disclosure. In the above shaped embodiments, the total length of slotted antenna conductor 105 remains approximately ¼ of the wavelength of the desired transmission or reception frequency. The slot for the above shaped antennas extends from the base of the antenna a distance $L_s$ along the antenna length following the same path as the shape of the antenna. Thus, for example, a meander shape antenna has a meander shape slot that follows the meander shape of the antenna.

In some embodiments, the feed line is not tapered as in FIG. 1, but is another shape compatible with embodiments of the disclosure. For example, the feed line is of constant width, tapers with an exponential shape, polynomial shape or another shape. In FIG. 1, the feed line 140 contacts the slotted antenna conductor 105 at the base 150. In other embodiments, the feed line 140 contacts the slotted antenna conductor 105 at a point compatible with embodiments of the disclosure, for example one quarter the length $L_t$ from the base 150. In some embodiments, the feed line 140 couples to the slotted antenna conductor 105 using capacitive coupling by, for example, being formed on the opposite side of the substrate to the slotted antenna conductor 105 and overlapping a portion of the slotted antenna conductor to form a coupling capacitor. In other embodiments, the capacitor is formed by having the feed line 140 on the same side of the substrate as the slotted antenna conductor 105, the feed line 140 formed close to but not touching the slotted antenna conductor 105.

Figure 6:
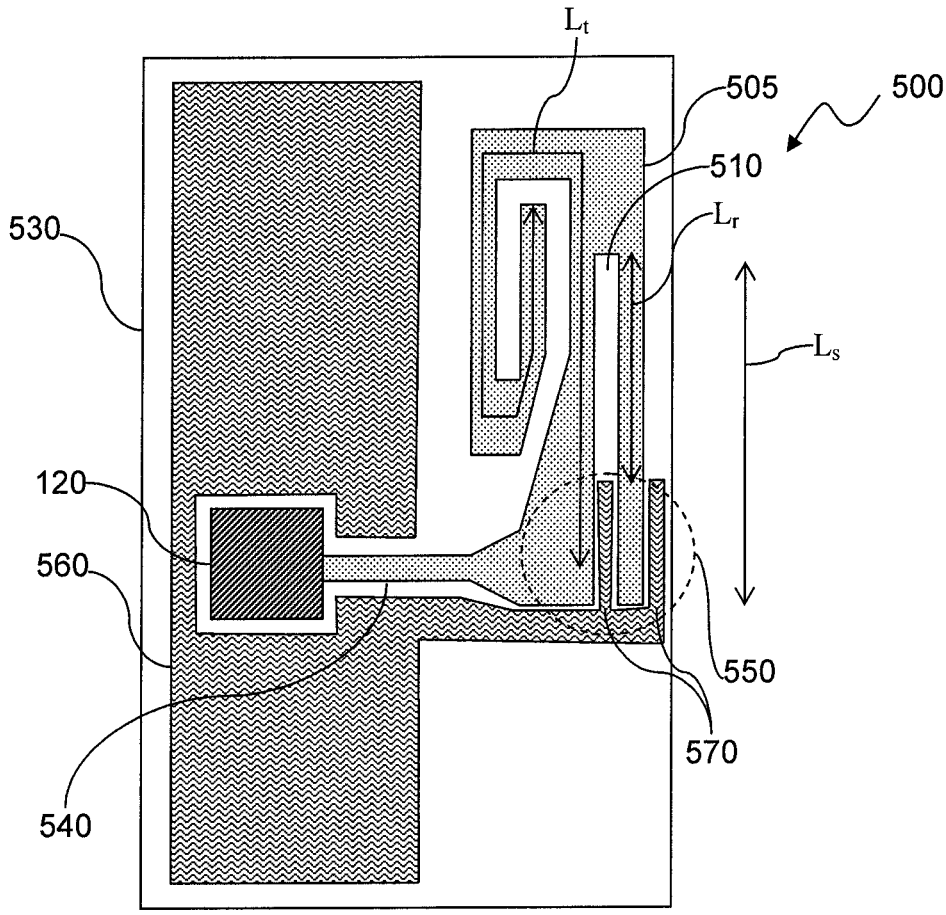
FIG. 6 is a top view of an antenna according to an embodiment.

FIG. 6 is a top view of an antenna 500 according to another embodiment. The antenna 500 is similar to the antenna 100, having slotted antenna conductor 505 with a slot 510. The ground plane 560 and the closing portion 570 are formed on the same side of the substrate 530 as the slotted antenna conductor 505. To form the capacitors of the closing portion at the base 550 of the antenna, the closing portion 570 is formed close to the metal surrounding the slot at the base 550 where the slotted antenna conductor 505 connects to the feed line 540. In some embodiments, the shape of the closing portion 570 surrounding the slot 510 at the base of the slotted antenna conductor 505 is a shape providing a suitable capacitance between the base of the slotted antenna conductor 505 and the closing portion 570. In FIG. 6, the closing portion 570 extends along the center of the slot 510 without contacting the slotted antenna conductor 505.

In the embodiments of FIGS. 1-3, 5 and 6 the closing portion is connected to the ground plane. In some embodiments, the closing portion is not connected to a ground plane but capacitively couples the two sides of the mechanically open end of the slot. In some embodiments with more than one slot, the corresponding closing portions are not connected to one another or to a ground plane but capacitively couple the two sides of the corresponding mechanically open end of the slot. A combination of closing portions connected to a ground plane with a combination of closing portions not connected to a ground plane, compatible with embodiments of the disclosure, is within the scope of this disclosure.

Figure 7:
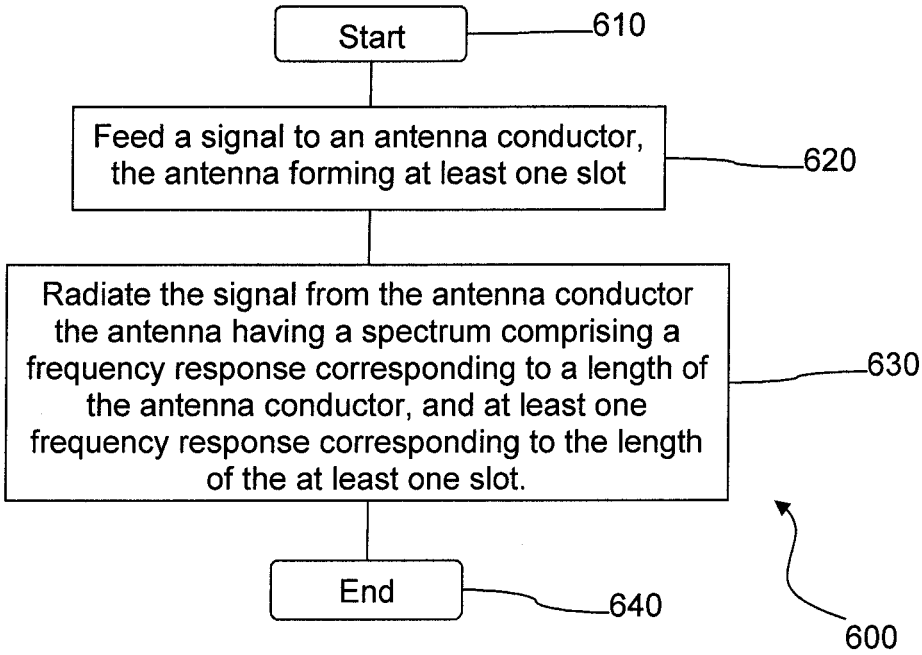
FIG. 7 is a flow chart of a method of transmitting a radio signal using a slotted antenna according to an embodiment.

FIG. 7 is a flow chart 600 of a method of transmitting a radio signal using the antenna 100. The method begins at step 610 and proceeds to step 620.

At step 620, a signal is fed to the antenna conductor 105 via the feed line 140 from the driving/receiving circuit 120. In other embodiments, the feed line used for a method is one of the above-described feed lines compatible with embodiments of the disclosure. Next the method proceeds to step 630.

At step 630, the signal is radiated from the slotted antenna conductor 105, the antenna 100 having a spectrum comprising a first frequency response corresponding to a length of the slotted antenna conductor 105 and a second frequency response corresponding to the length of the slot 110 in the slotted antenna conductor 105. In other embodiments, the slotted antenna conductor used is one of the above-described slotted antenna conductors compatible with embodiments of the disclosure. In some embodiments, any number of frequency responses corresponding to the length of additional slots compatible with embodiments of the disclosure is within the scope of this disclosure. Moreover, in other embodiments, any of the above-described structures for capacitively closing the slot 110 compatible with embodiments of the disclosure is within the scope of this disclosure.

Next the method proceeds to step 640 where the method terminates.

Figure 8:
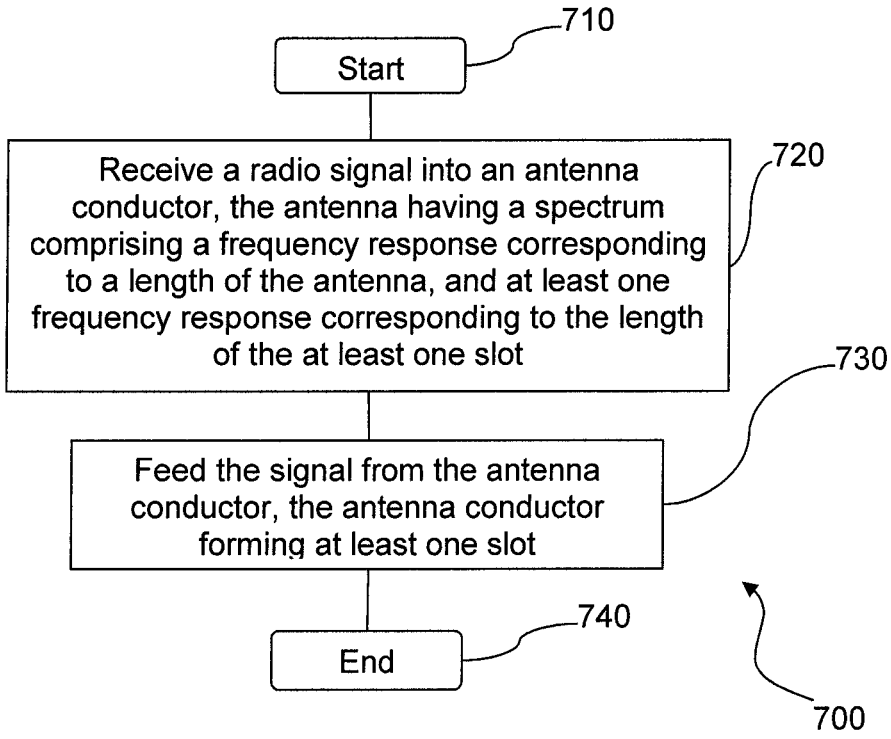
FIG. 8 is a flow chart of a method of receiving a radio signal using a slotted antenna according to an embodiment.

FIG. 8 is a flow chart 700 of a method of receiving a radio signal using the antenna 100. The method begins at step 710 and proceeds to step 720.

At step 730 a signal is received by the slotted antenna conductor 105, the antenna having a spectrum comprising a first frequency response corresponding to a length of the slotted antenna conductor 105 and a second frequency response corresponding to the length of the slot 110 in the slotted antenna conductor 105. In other embodiments, the slotted antenna conductor used is one of the above-described slotted antenna conductors compatible with embodiments of the disclosure. In some embodiments, any number of frequency responses corresponding to the length of additional slots compatible with embodiments of the disclosure is within the scope of this disclosure. Moreover, in some embodiments, one or more of the above-described structures for capacitively closing the slot 110 compatible with embodiments of the disclosure is within the scope of this disclosure.

Next the method proceeds to step 730.

At step 720, the signal is fed from the slotted antenna conductor 105 via the feed line 140 to the driver/receiver circuit 120. In other embodiments, the feed line used for a method is one of the above-described feed lines compatible with embodiments of the disclosure.

The method proceeds to step 740 where the method terminates.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. An antenna comprising:

a signal feeding structure;

an antenna conductor coupled to the signal feeding structure, the antenna conductor forming at least one slot therein; and a corresponding portion of a ground plane capacitively closing an open end of the at least one slot.

2. The antenna according to claim 1, the corresponding portion of the ground plane formed on an opposite side of a substrate to the antenna conductor.

3. The antenna according to claim 2, the corresponding portion of the ground plane formed on directly opposite to the open end of the at least one slot.

4. The antenna according to claim 1, the corresponding portion of the ground plane formed on a same side of a substrate to the antenna conductor.

5. The antenna according to claim 2, the corresponding portion of the ground plane formed on adjacent to the open end of the at least one slot.

6. The antenna according to claim 1, the antenna conductor forming a monopole antenna of length corresponding to substantially ¼ a wavelength of a transmission or reception frequency of the antenna.

7. The antenna according to claim 1, the antenna conductor formed in a spiral shape.

8. The antenna according to claim 1, a length of the at least one slot and a capacitance value of the capacitively closed open end, selected to at least one of broaden a bandwidth of the antenna, increase a gain of the antenna or match the antenna to a driving/receiving circuit.

9. An antenna comprising:

a signal feed line;

an antenna conductor coupled to the signal feed line, the antenna conductor forming at least one slot therein;

a corresponding closing portion capacitively closing the at least one slot at a mechanically open end.

10. The antenna according to claim 9, the corresponding closing portion formed on an opposite side of an insulator to the antenna conductor, directly opposite to the open end of the at least one slot.

11. The antenna according to claim 9, the corresponding closing portion formed on a same side of an insulator to the antenna conductor, adjacent to the open end of the at least one slot.

12. The antenna according to claim 11, a material of the insulator forming a dielectric for the closing portion capacitance.

13. The antenna according to claim 9, a length of the at least one slot and a capacitance value of the capacitively closed open end, selected to at least one of broaden a bandwidth of the antenna, increase a gain of the antenna or match the antenna to a driving/receiving circuit.

14. The antenna according to claim 9, a length of the at least one slot from 1/16 to 1/8 of a length corresponding to substantially a wavelength of a transmission or reception frequency of the antenna.

15. A method of at least one of transmitting or receiving a radio signal comprising:

at least one of:

feeding a first signal to an antenna conductor, the antenna conductor forming at least one slot; and radiating the first signal from the antenna conductor, the antenna conductor having a spectrum comprising:

a first frequency response corresponding to a length of the antenna conductor; and at least one second frequency response corresponding to the length of the at least one slot; or receiving a second signal into the antenna conductor having the spectrum;

feeding the second signal from the antenna conductor;

wherein a corresponding closing portion of the antenna conductor capacitively closes the at least one slot.

16. The method according to claim 15, forming the corresponding closing portion on an opposite side of a substrate to the antenna conductor, directly opposite to a mechanically open end of the at least one slot.

17. The method according to claim 15, forming the corresponding closing portion on a same side of a substrate to the antenna conductor, adjacent to a mechanically open end of the at least one slot.

18. The method according to claim 15, selecting a value of the first frequency response and a value of the at least one second frequency response, to at least one of broaden a bandwidth of the antenna conductor, increase a gain of the antenna conductor or match the antenna conductor to a driving/receiving circuit.

19. The method according to claim 18, selecting the length of the at least one slot to be from 1/16 to 1/8 of a length corresponding to substantially a wavelength of a transmission or reception frequency of the antenna conductor.

* * * * *